US011136527B2

(12) United States Patent
Zhang et al.

(10) Patent No.: US 11,136,527 B2
(45) Date of Patent: Oct. 5, 2021

(54) LUBRICANT AND METHOD OF PREPARING THE SAME

(71) Applicant: Henan University, Kaifeng (CN)

(72) Inventors: Yujuan Zhang, Kaifeng (CN); Shengmao Zhang, Kaifeng (CN); Pingyu Zhang, Kaifeng (CN); Zhijun Zhang, Kaifeng (CN)

(73) Assignee: HENAN UNIVERSITY, Kaifeng (CN)

( * ) Notice: Subject to any disclaimer, the term of this patent is extended or adjusted under 35 U.S.C. 154(b) by 40 days.

(21) Appl. No.: 16/684,535

(22) Filed: Nov. 14, 2019

(65) Prior Publication Data

US 2020/0080019 A1 Mar. 12, 2020

Related U.S. Application Data

(63) Continuation-in-part of application No. PCT/CN2018/084216, filed on Apr. 24, 2018.

(30) Foreign Application Priority Data

Aug. 30, 2017 (CN) ..... 201710761292.4

(51) Int. Cl.
*C10M 169/04* (2006.01)
*C10M 105/38* (2006.01)
(Continued)

(52) U.S. Cl.
CPC ..... *C10M 169/044* (2013.01); *C10M 105/38* (2013.01); *C10M 107/02* (2013.01);
(Continued)

(58) Field of Classification Search
CPC ..... C10M 169/044; C10M 105/38; C10M 107/02; C10M 111/04; C10M 125/04;
(Continued)

(56) References Cited

U.S. PATENT DOCUMENTS 5,151,205 A * 9/1992 Culpon, Jr. ..... C10M 135/30 508/485
6,462,001 B1 * 10/2002 Kenbeek ..... C10M 105/42 508/492
2010/0286414 A1 * 11/2010 Bera ..... C08F 283/00 549/323

FOREIGN PATENT DOCUMENTS

CN 1618799 A * 5/2005
CN 101200667 B * 5/2010
(Continued)

OTHER PUBLICATIONS

CAS # 91050-89-4, Priolube 370, Priolube 3970, Fatty acids C8-10 triesters with trimethylolpropane (chemblink.com) available onlline for commercial product cited in reference (Year: 2021).*

*Primary Examiner* — Pamela H Weiss
(74) *Attorney, Agent, or Firm* — Matthias Scholl P.C.; Matthias Scholl

(57) ABSTRACT

A lubricant, including, by weight: 80-85 parts of a base oil; 1-2 parts of a methyl-silicone oil; 1-2 parts of polymethacrylate; 2-4 parts of pentaerythritol polyisobutylene succinate; 1-2 parts of di-n-butyl phosphite; 2-3 parts of butylhydroxytoluene; 2-4 parts of an ethylene-propylene copolymer; 1-2 parts of an alkenyl succinate; and 3-5 parts of copper nanoparticles. A method of preparing the lubricant includes: adding the base oil, the methyl-silicone oil, the polymethacrylate, the ethylene-propylene copolymer, the butylhydroxytoluene, the alkenyl succinate to a reactor, and stirring a resulting first mixture under normal temperature and pressure at 300-400 rpm for 3-4 hours, to yield a primary product; and adding the di-n-butyl phosphite, the pentaerythritol polyisobutylene succinate, and the copper nanoparticles to the primary product, and stirring a resulting second mixture at 150-250 rpm for 2-2.5 hours.

4 Claims, 2 Drawing Sheets

(51) Int. Cl.

| | |
|---|---|
| ***C10M 107/02*** | (2006.01) |
| ***C10M 111/04*** | (2006.01) |
| ***C10M 125/04*** | (2006.01) |
| ***C10M 129/10*** | (2006.01) |
| ***C10M 129/72*** | (2006.01) |
| ***C10M 137/02*** | (2006.01) |
| ***C10M 141/10*** | (2006.01) |
| ***C10M 143/04*** | (2006.01) |
| ***C10M 145/14*** | (2006.01) |
| ***C10M 145/22*** | (2006.01) |
| ***C10M 155/02*** | (2006.01) |
| ***C10M 157/10*** | (2006.01) |
| ***C10N 20/06*** | (2006.01) |
| ***C10N 30/06*** | (2006.01) |
| ***C10N 40/25*** | (2006.01) |

(52) U.S. Cl.

CPC ..... *C10M 111/04* (2013.01); *C10M 125/04* (2013.01); *C10M 129/10* (2013.01); *C10M 129/72* (2013.01); *C10M 137/02* (2013.01); *C10M 141/10* (2013.01); *C10M 143/04* (2013.01); *C10M 145/14* (2013.01); *C10M 145/22* (2013.01); *C10M 155/02* (2013.01); *C10M 157/10* (2013.01); *C10M 2201/05* (2013.01); *C10M 2205/024* (2013.01); *C10M 2205/0206* (2013.01); *C10M 2207/023* (2013.01); *C10M 2207/282* (2013.01); *C10M 2207/2835* (2013.01); *C10M 2209/084* (2013.01); *C10M 2209/102* (2013.01); *C10M 2223/049* (2013.01); *C10M 2229/02* (2013.01); *C10N 2020/06* (2013.01); *C10N 2030/06* (2013.01); *C10N 2040/25* (2013.01)

(58) Field of Classification Search

CPC ..... C10M 129/10; C10M 129/72; C10M 137/02; C10M 141/10; C10M 143/04; C10M 145/14; C10M 145/22; C10M 155/02; C10M 157/10; C10M 2201/05; C10M 2205/0206; C10M 2205/024; C10M 2207/023; C10M 2207/282; C10M 2207/2835; C10M 2209/084; C10M 2209/102; C10M 2223/049; C10M 2229/02; C10M 2207/026; C10M 2205/02; C10M 2229/041; C10M 2201/14; C10M 2205/0285; C10N 2020/06; C10N 2030/06; C10N 2040/25; C10N 2050/025; C10N 2030/04

See application file for complete search history.

(56) References Cited

FOREIGN PATENT DOCUMENTS

| | | | | |
|---|---|---|---|---|
| CN | 104449949 A | * | 3/2015 | |
| WO | WO-2017019654 A1 | * | 2/2017 | ..... C10M 135/08 |

* cited by examiner

LUBRICANT AND METHOD OF PREPARING THE SAME

CROSS-REFERENCE TO RELATED APPLICATIONS

This application is a continuation-in-part of International Patent Application No. PCT/CN2018/084216 with an international filing date of Apr. 24, 2018, designating the United States, and further claims foreign priority benefits to Chinese Patent Application No. 201710761292.4 filed Aug. 30, 2017. The contents of all of the aforementioned applications, including any intervening amendments thereto, are incorporated herein by reference. Inquiries from the public to applicants or assignees concerning this document or the related applications should be directed to: Matthias Scholl PC., Attn.: Dr. Matthias Scholl Esq., 245 First Street, 18th Floor, Cambridge, Mass. 02142.

BACKGROUND

This disclosure relates to a lubricant and a method of preparing the same.

A lubricant is a substance introduced to reduce friction between surfaces in mutual contact, which ultimately reduces the heat generated when the surfaces move.

Engine lubricants are widely used to reduce the friction between the metal surfaces of an engine. In recent years, the sliding parts of the engines also have been coated with a carbon film to reduce the frictional wear. However, conventional engine lubricants are incompatible with carbon films and tend to degrade them.

SUMMARY

Disclosed are a lubricant and a method of preparing the same. The lubricant exhibits stable dispersion and antioxidant properties, and can lubricate an engine that has sliding parts coated with a carbon film.

The disclosure provides a lubricant, comprising, by weight:

80-85 parts of a base oil;
1-2 parts of a methyl-silicone oil;
1-2 parts of polymethacrylate;
2-4 parts of pentaerythritol polyisobutylene succinate;
1-2 parts of di-n-butyl phosphite;
2-3 parts of butylhydroxytoluene;
2-4 parts of an ethylene-propylene copolymer;
1-2 parts of an alkenyl succinate; and
3-5 parts of copper nanoparticles.

The base oil can comprise 70 wt. % of a synthetic oil and 30 wt. % of a trimethylolpropane ester, and the synthetic oil can be a polyalphaolefin (PAO).

The polyalphaolefin (PAO) can be PAO6, PAO8, or PAO10.

Also provided is a method of preparing a lubricant, the method comprising:

adding 80-85 parts of a base oil, 1-2 parts of a methyl-silicone oil, 1-2 parts of polymethacrylate, 2-4 parts of an ethylene-propylene copolymer, 2-3 parts of butylhydroxytoluene, 1-2 parts of an alkenyl succinate to a reactor, and stirring a resulting first mixture under normal temperature and pressure (NTP) at 300-400 rpm for 3-4 hours, to yield a primary product; and adding 1-2 parts of di-n-butyl phosphite, 2-4 parts of pentaerythritol polyisobutylene succinate, and 3-5 parts of copper nanoparticles to the primary product, and stirring a resulting second mixture at 150-250 rpm for 2-2.5 hours.

The materials involved in the method can be purchased from the market. The copper nanoparticles can be modified by dioctyl dithiophosphate. The modifier accounts for 50-70 wt. % of the total weight of the modified copper nanoparticles. The particle size of the copper nanoparticles is 3-5 nm. The particle size distribution can improve the dispersion stability and chemical stability of the copper in the base oil, thus improving the lubrication function of the lubricant.

Copper nanoparticles have strong nucleophilic force on both metals and carbon films, and thus the deposits are formed on both surfaces to reduce friction and wear between the two surfaces.

Advantages of the lubricant and the method of preparing the same as described in the disclosure are summarized as follows. The surface modified copper nanoparticles can form a lubricating film on the surface of a carbon film (the carbon film can be a pure carbon film, a Si-doped carbon film, an Al-doped carbon film, or a H-doped carbon film), improving the anti-friction and anti-wear properties of the carbon film-coated sliding parts of an engine. The copper nanoparticles exhibit affinity with metal friction pairs and carbon films, so that the lubricant can be widely used in various engines. The dispersion of the lubricant is uniform and stable, improving the lubricating efficiency. The method of preparing the lubricant is carried out under normal temperature and pressure.

DETAILED DESCRIPTION

Figure 1A:
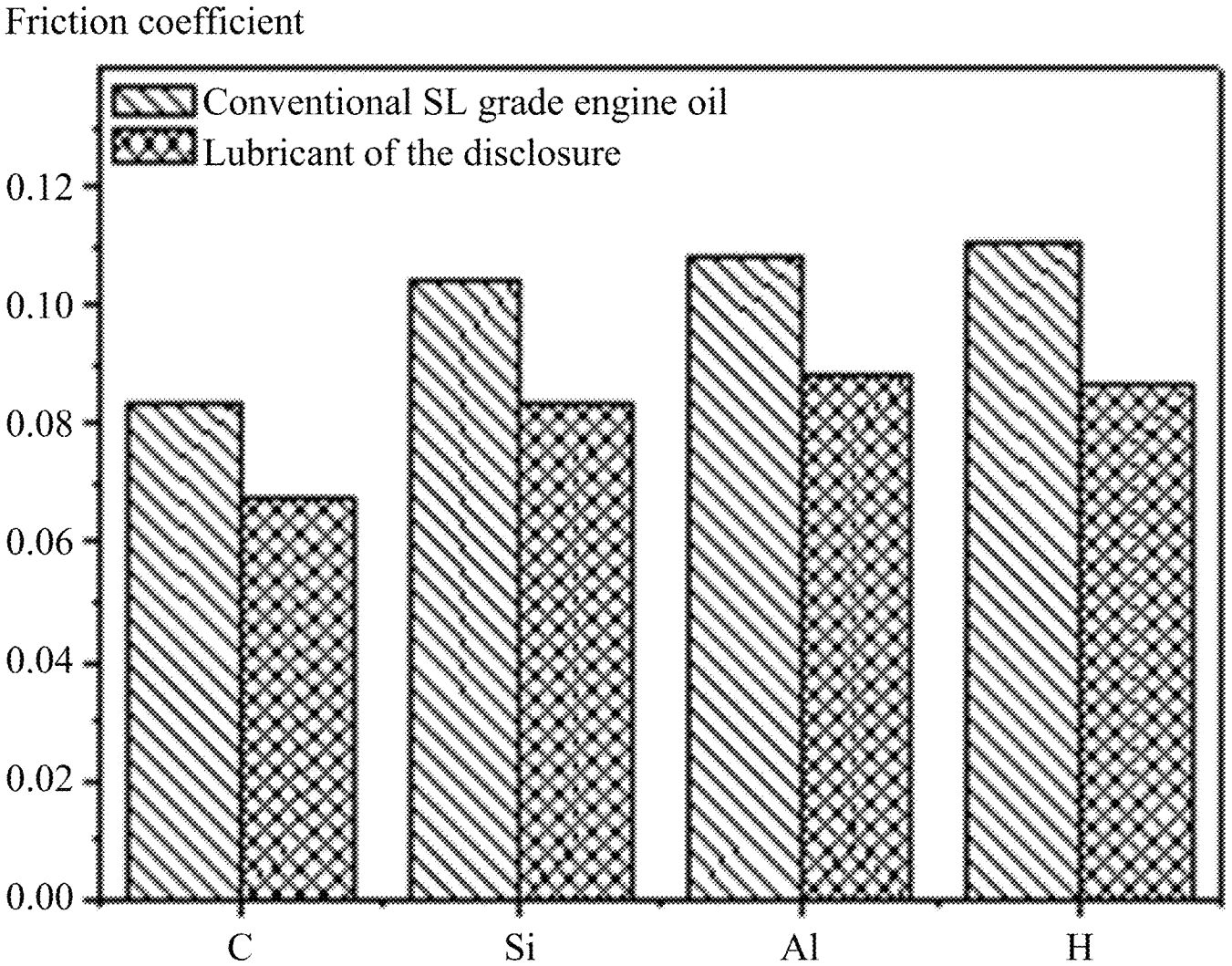
FIG. 1A is comparison of friction coefficients of four types of carbon films (that is, pure carbon film, Si-doped carbon film, Al-doped carbon film, H-doped carbon film) lubricated by conventional SL grade engine oil and a lubricant as described in the disclosure.

To further illustrate, embodiments detailing a lubricant and a method of preparing the same are described below. It should be noted that the following embodiments are intended to describe and not to limit the disclosure.

Example 1

Dispersion stability test of copper nanoparticles in lubricants

The copper nanoparticles were modified by dioctyl dithiophosphate which accounted for 60 wt. % of the modified copper nanoparticles. The copper nanoparticles had an average particle size of 4 nm and the $C_8$-alkyl chain modifier was distributed outside the copper nanoparticles. The copper nanoparticles were mixed with different dispersants in different additive amounts for the study of dispersion stability in lubricants.

The mixtures of the copper nanoparticles and different dispersants in different additive amounts were respectively dissolved in a base oil comprising 70 wt. % of a synthetic oil and 30 wt. % of a trimethylolpropane ester, and the synthetic oil was polyalphaolefin 6 (PAO6). 24 hours later, the mixtures were centrifuged at 30° C. under 8000 rpm for 20 min. 10 mL of supernates were collected, and the transmittance thereof were measured using an UV spectrophotometer.

The copper nanoparticles contained a $C_8$-alkyl chain modifier so that they had excellent dispersion stability. However, the addition of the dispersant changed the dispersion stability of the copper nanoparticles, and the dispersant competed with the modifier to adsorb on the copper core. Once the protection of modifier disappeared, the copper nanoparticles tended to oxidize, and the color changed from brown red to grey green, deteriorating the lubricity. On the other hand, the addition of the dispersants changed the agglomeration of the copper nanoparticles, thus adversely affecting its dispersion stability in the base oil. The test results are shown in Table 1 and Table 2.

TABLE 1

Influence of different types of dispersants on the dispersion stability of copper nanoparticles

| Copper nanoparticles (Weight parts) | Dispersants (3 parts by weight) | Primary transmittance (%) | Transmittance after centrifugation (%) | Increase ratio of transmittance (%) | Color of lubricants |
|---|---|---|---|---|---|
| 4 | T151-Monoalkenyl succinimide | 78.6 | 85.6 | 8.9 | Greyish green |
| 4 | T152-Dialkenyl succinimide | 78.6 | 86.4 | 9.9 | Greyish green |
| 4 | T153-Multialkenyl succinimide | 78.5 | 84.8 | 8.0 | Greyish green |
| 4 | T161-High molecular weight (poly)succinimide | 78.8 | 86.7 | 10.0 | Greyish green |
| 4 | T171-Pentaerythritol polyisobutylene succinate | 78.6 | 80.3 | 2.2 | Brownish red |

TABLE 2

Influence of different weight ratios of dispersants to copper nanoparticles on the dispersion stability of copper nanoparticles

| Copper nanoparticles (Weight parts) | Dispersant T171-Pentaerythritol polyisobutylene succinate (Weight parts) | Primary transmittance (%) | Transmittance after centrifugation (%) | Increase ratio of transmittance (%) | Color of lubricants |
|---|---|---|---|---|---|
| 2 | 4 | 82.4 | 83.5 | 1.3 | Brownish red |
| 3 | 4 | 80.3 | 81.6 | 1.6 | Brownish red |
| 4 | 4 | 78.6 | 80.3 | 2.2 | Brownish red |
| 5 | 4 | 76.8 | 80.3 | 4.6 | Brownish red |
| 6 | 4 | 72.4 | 80.1 | 10.6 | Brownish red |
| 4 | 1 | 78.8 | 80.3 | 1.9 | Brownish red |
| 4 | 2 | 78.8 | 80.3 | 1.9 | Brownish red |
| 4 | 3 | 78.7 | 80.3 | 2.0 | Brownish red |
| 4 | 4 | 78.6 | 80.3 | 2.2 | Brownish red |
| 4 | 5 | 76.3 | 80.5 | 5.5 | Brownish red |
| 4 | 6 | 73.5 | 80.6 | 9.7 | Brownish red |

The results showed that, the polyamide dispersants (T151, T152, T153, T161, produced by Xinxiang Ruifeng New Materials Co., Ltd.) competed with the modifier of the copper nanoparticles to adsorb on the copper nanoparticles, so that the copper nanoparticles were oxidized and deteriorated. However, the pentaerythritol ester dispersants (T171, produced by Lanzhou Lubo Runlan Refining Additives Co., Ltd.) can efficiently disperse the copper nanoparticles. Too many of the dispersants caused the agglomerates of the copper nanoparticles to deposit, so that the additive amount were about 2-4 weight parts.

Example 2

The copper tends to oxidize the lubricant. Thus, the copper nanoparticles need to cooperate with different antioxidants to improve the antioxidant ability of the lubricant. Different antioxidants were mixed with a base oil comprising 70 wt. % of a synthetic oil and 30 wt. % of a trimethylolpropane ester, and the synthetic oil was polyalphaolefin 6 (PAO6). The antioxidant properties of the base oil were listed in Table 3.

TABLE 3

Antioxidant properties of base oil with different antioxidants

| Copper nanoparticles (Weight parts) | Antioxidants (2 parts by weight) | Initial oxidation temperature (° C.) | Oxidation induction time (min) |
|---|---|---|---|
| 0 | | 211.3 | 0.1 |
| 4 | | 219.3 | 7.8 |
| 4 | T501-2, 6-Di-tert-butyl-4-methylphenol | 224.5 | 14.0 |
| 4 | T512-Methyl 3,5-methyl-β-(3,5-di-tert-butyl-4-hydroxyphenyl)propanoate | 242.6 | 21.6 |
| 4 | T521-2,6-Di-tert-butyl-4-(dimethylaminomethyl)phenol | 223.7 | 8.7 |
| 4 | T531-N-Phenyl-α-naphthylamine | 226.3 | 11.9 |
| 4 | T534-Butyl-octyl-diphenylamine | 238.0 | 19.2 |

The results show that, the copper nanoparticles can improve the antioxidant ability of the base oil. When mixing with the antioxidant T512, the antioxidant ability of the lubricant has been improved to the greatest extent.

Example 3

The copper nanoparticles as soft metals have excellent antifriction and repair functions, but under high load and extreme pressure conditions, the copper nanoparticles cooperate with an anti-wear agent to form a synergistic effect to achieve extreme pressure lubrication effect. The anti-wear agent is a mostly organic polar compound containing sulfur, phosphorus and chlorine. The extreme pressure anti-wear ability of the lubricant is evaluated by measuring its $P_B$ (maximum nonseizure load) and $P_D$ (minimum sintering load).

TABLE 4

Extreme pressure anti-wear ability of lubricant with different anti-wear agents

| Copper nanoparticles (Weight parts) | Anti-wear agents (2 parts by weight) | $P_B$ (N) | $P_D$ (N) |
|---|---|---|---|
| 0 | | 372 | 568 |
| 4 | | 813 | 5500 |
| 4 | T301-Chlorinated paraffins | 900 | 7080 |
| 4 | T304-Acid dibutyl phosphite | 945 | 7300 |
| 4 | T305-Nitrogen-containing derivatives of dithiophosphoric acid | 812 | 5560 |
| 4 | T306-Tricresyl phosphate | 760 | 5100 |
| 4 | T307-Thiophosphoric acid amine Salt | 715 | 3960 |
| 4 | T308-Isooctyl acid phosphate octadecylamine salt | 543 | 2920 |
| 4 | T309-Triphenyl thiophosphate | 615 | 4600 |
| 4 | T321-Sulfurized isobutylene | 342 | 1960 |
| 4 | T322-Dibenzyl disulfide | 356 | 2020 |
| 4 | T323-Aminothioester | 273 | 1560 |
| 4 | T341-Lead naphthenate | 630 | 6300 |
| 4 | T351-DibutylCarbamodithiotic acid molybdenum salt | 730 | 4860 |
| 4 | T352-DibutylCarbamodithiotic acid antimonic salt | 750 | 5260 |
| 4 | T353-DibutylCarbamodithiotic acid lead salt | 780 | 6430 |

The results show that, the copper nanoparticles greatly improve the extreme pressure anti-wear ability of the base oil. When mixing with the anti-wear agent T304 (dibutyl phosphite), the copper nanoparticles can improve the $P_B$ and $P_D$ of the lubricant to the greatest extent.

Example 4

A lubricant comprises: 80 parts of a base oil; 2 parts of a methyl-silicone oil; 1 part of polymethacrylate; 4 parts of pentaerythritol polyisobutylene succinate; 2 parts of di-n-butyl phosphite; 3 parts of butylhydroxytoluene; 4 parts of an ethylene-propylene copolymer; 1 part of alkenyl succinate; and 3 parts of copper nanoparticles. The base oil comprises 70 wt. % of a synthetic oil and 30 wt. % of a trimethylolpropane ester, and the synthetic oil is a polyalphaolefin 6 (PAO6).

A method of preparing the lubricant comprises:

adding the base oil, the methyl-silicone oil, the polymethacrylate, the ethylene-propylene copolymer, the butylhydroxytoluene, the alkenyl succinate to a reactor, and stirring a resulting first mixture under normal temperature and pressure (NTP) at 300 rpm for 4 hours, to yield a primary product; and adding the di-n-butyl phosphite, the pentaerythritol polyisobutylene succinate, and the copper nanoparticles to the primary product, and stirring a resulting second mixture at 150 rpm for 2.5 hours.

Example 5

A lubricant comprises: 82 parts of a base oil; 2 parts of a methyl-silicone oil; 1 part of polymethacrylate; 2 parts of pentaerythritol polyisobutylene succinate; 1 part of di-n-butyl phosphite; 3 parts of butylhydroxytoluene; 3 parts of an ethylene-propylene copolymer; 2 parts of alkenyl succinate; and 4 parts of copper nanoparticles. The base oil comprises 70 wt. % of a synthetic oil and 30 wt. % of a trimethylolpropane ester, and the synthetic oil is a polyalphaolefin 8 (PAO8).

A method of preparing the lubricant comprises:

adding the base oil, the methyl-silicone oil, the polymethacrylate, the ethylene-propylene copolymer, the butylhydroxytoluene, the alkenyl succinate to a reactor, and stirring a resulting first mixture under normal temperature and pressure (NTP) at 400 rpm for 3 hours, to yield a primary product; and adding the di-n-butyl phosphite, the pentaerythritol polyisobutylene succinate, and the copper nanoparticles to the primary product, and stirring a resulting second mixture at 250 rpm for 2 hours.

Example 6

A lubricant comprises: 85 parts of a base oil; 1 part of a methyl-silicone oil; 1 part of polymethacrylate; 2 parts of pentaerythritol polyisobutylene succinate; 1 part of di-n-butyl phosphite; 2 parts of butylhydroxytoluene; 2 parts of an ethylene-propylene copolymer; 1 part of alkenyl succinate; and 5 parts of copper nanoparticles. The base oil comprises 70 wt. % of a synthetic oil and 30 wt. % of a trimethylolpropane ester, and the synthetic oil is a polyalphaolefin 10 (PAO10).

A method of preparing the lubricant comprises:

adding the base oil, the methyl-silicone oil, the polymethacrylate, the ethylene-propylene copolymer, the butylhydroxytoluene, the alkenyl succinate to a reactor, and stirring a resulting first mixture under normal temperature and pressure (NTP) at 350 rpm for 4 hours, to yield a primary product; and adding the di-n-butyl phosphite, the pentaerythritol polyisobutylene succinate, and the copper nanoparticles to the primary product, and stirring a resulting second mixture at 200 rpm for 2.5 hours.

Figure 1B:
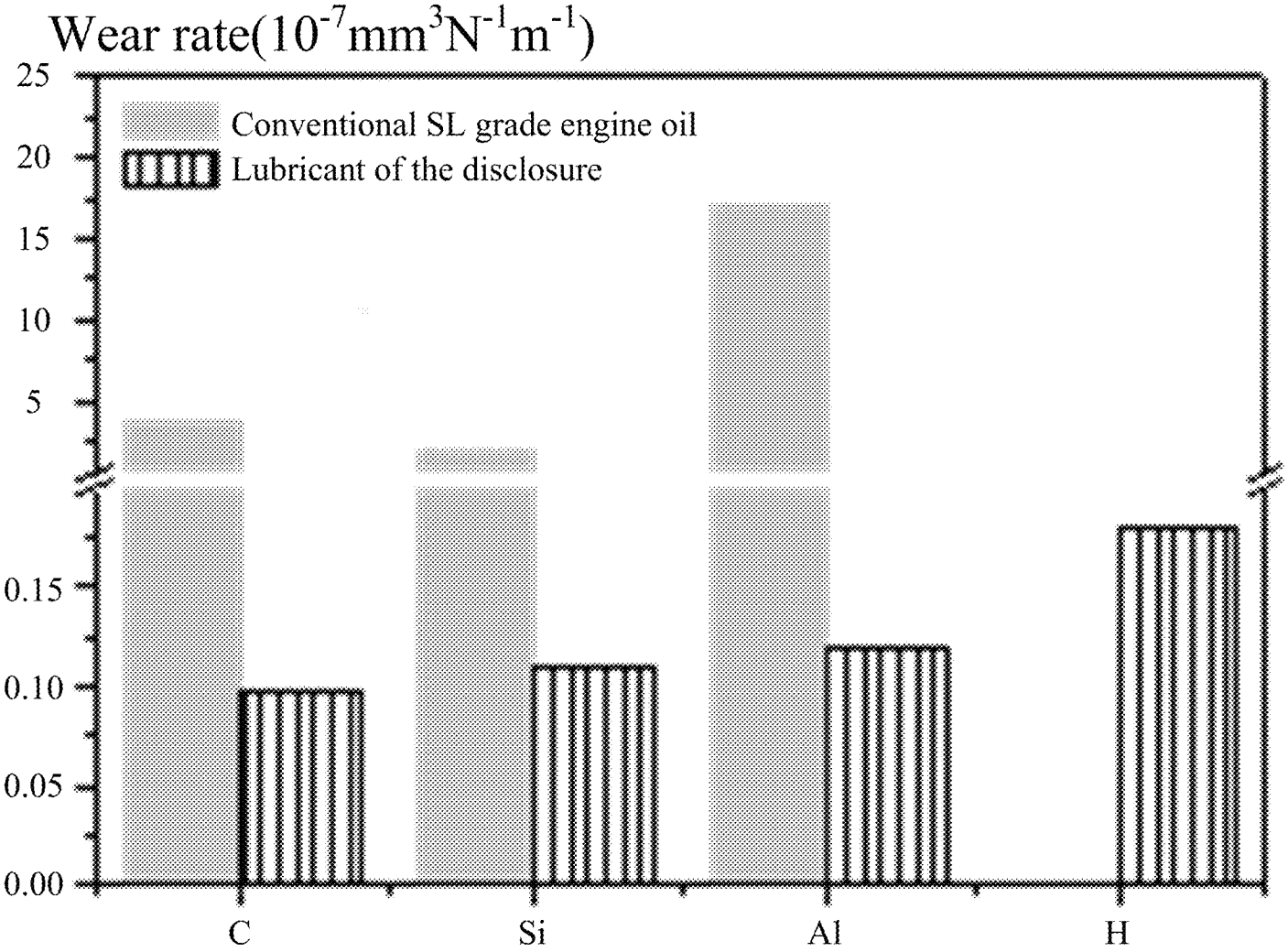
FIG. 1B is comparison of wear rates of four types of carbon films (that is, pure carbon film, Si-doped carbon film, Al-doped carbon film, H-doped carbon film) lubricated by conventional SL grade engine oil and a lubricant as described in the disclosure.

The properties of the lubricants prepared in above examples are tested and the test results are shown in FIGS. 1A-1B. The friction pairs employed in the tests comprise one of four types of carbon films (that is, pure carbon film, Si-doped carbon film, Al-doped carbon film, H-doped carbon film) and stainless-steel balls. Friction conditions: the stainless-steel balls have a diameter of 4 mm, a single stroke of 5 mm, a linear velocity of 10 mm/s and a vertical load of 8 N. The experiments are carried out at room temperature. As shown in FIGS. 1A and 1B, compared with the SL grade engine oil on the market, the lubricant as described in the disclosure can reduce the friction coefficient and wear rate of the four types of carbon films by 9-19% and 93-99%, respectively. It can be concluded that the lubricant of the disclosure can effectively protect the carbon film and exhibit efficient lubricating properties.

It will be obvious to those skilled in the art that changes and modifications may be made, and therefore, the aim in the appended claims is to cover all such changes and modifications.

What is claimed is:

1. A method of preparing, a lubricant, the lubricant comprising by weight:

80-85 parts of a base oil;

1-2 parts of a methyl-silicone oil per 80-85 parts of the base oil;

1-2 parts of polymethacrylate per 80-85 parts of the base oil;

2-4 parts of pentaerythritol polyisobutylene succinate per 80-85 parts of the base oil;

1-2 parts of di-n-butyl phosphite per 80-85 parts of the base oil;

2-3 parts of butylhydroxytoluene per 80-85 parts of the base oil;

2-4 parts of an ethylene-propylene copolymer per 80-85 parts of the base oil;

1-2 parts of an alkenyl succinate per 80-85 parts of the base oil; and 3-5 parts of copper nanoparticles per 80-85 parts of the base oil; the method comprising:

adding the base oil, the methyl-silicone oil, polymethacrylate, the ethylene-propylene copolymer, butylhydroxytoluene, the alkenyl succinate to a reactor, and stirring a resulting first mixture under normal temperature and pressure (NTP) at 300-400 rpm for 3-4 hours, to yield a primary product; and adding di-n-butyl phosphite, pentaerythritol polyisobutylene succinate, and the copper nanoparticles to the primary product, and stirring a resulting second mixture at 150-250 rpm for 2-2.5 hours.

2. The method of claim 1, wherein the base oil comprises 70 wt. % of a synthetic oil and 30 wt. % of a trimethylolpropane ester, and the synthetic oil is a polyalphaolefin (PAO).

3. The method of claim 2, wherein the polyalphaolefin (PAO) is PAO6, PAO8, or PAO10.

4. A lubricant, comprising, by weight:

80-85 parts of a base oil;

1-2 parts of a methyl-silicone oil per 80-85 parts of the base oil;

1-2 parts of polymethacrylate per 80-85 parts of the base oil;

2-4 parts of pentaerythritol polyisobutylene succinate per 80-85 parts of the base oil;

1-2 parts of di-n-butyl phosphite per 80-85 parts of the base oil;

2-3 parts of butylhydroxytoluene per 80-85 parts of the base oil;

2-4 parts of an ethylene-propylene copolymer per 80-85 parts of the base oil;

1-2 parts of an alkenyl succinate per 80-85 parts of the base oil; and 3-5 parts of copper nanoparticles per 80-85 parts of the base oil, wherein the lubricant further comprises dioctyl dithiophosphate distributed outside the copper nanoparticles; dioctyl dithiophosphate is present in an amount of between 50% and 70%, by weight of the copper nanoparticles.

* * * * *